US009790710B2

(12) United States Patent
Talpe

(10) Patent No.: US 9,790,710 B2
(45) Date of Patent: Oct. 17, 2017

(54) PUSHBUTTON COMBINATION LOCK

(71) Applicant: Joseph Talpe, Heestert-Zwevegem (BE)

(72) Inventor: Joseph Talpe, Heestert-Zwevegem (BE)

( * ) Notice: Subject to any disclaimer, the term of this patent is extended or adjusted under 35 U.S.C. 154(b) by 159 days.

(21) Appl. No.: 14/577,217

(22) Filed: Dec. 19, 2014

(65) Prior Publication Data

US 2015/0176308 A1 Jun. 25, 2015

(30) Foreign Application Priority Data

Dec. 20, 2013 (EP) ..... 13199105

(51) Int. Cl.
*E05B 13/00* (2006.01)
*E05B 37/16* (2006.01)
(Continued)

(52) U.S. Cl.
CPC ..... *E05B 37/16* (2013.01); *E05B 3/00* (2013.01); *E05B 37/00* (2013.01); *E05B 63/04* (2013.01);
(Continued)

(58) Field of Classification Search
CPC . E05B 37/16; E05B 37/00; E05B 3/00; E05B 63/04; E05B 65/0007;
(Continued)

(56) References Cited

U.S. PATENT DOCUMENTS 352,515 A * 11/1886 Bullard ..... E05C 1/163
292/169.22
1,531,269 A * 3/1925 Biddle ..... E05B 37/16
70/211
(Continued)

FOREIGN PATENT DOCUMENTS

EP 0 942 127 A1 9/1999
EP 1 336 708 A1 8/2003
(Continued)

OTHER PUBLICATIONS

European Patent Search Report for EP13199105.1 completed Jul. 18, 2014.

*Primary Examiner* — Lloyd Gall
(74) *Attorney, Agent, or Firm* — Koppel, Patrick, Heybl & Philpott

(57) ABSTRACT

The pushbutton combination lock has a lock bolt mechanism with a lock bolt movably mounted on a frame between a locking position and an unlocking position. The lock bolt mechanism further has two lock bolt actuating mechanisms arranged to move the lock bolt between the locking position and the unlocking position. The lock has a pushbutton combination locking mechanism for locking the first lock bolt actuating mechanism to prevent the lock bolt from being moved by the first lock bolt actuating mechanism to the unlocking position while the second lock bolt actuating mechanism is independent from the pushbutton combination locking mechanism. The pushbutton combination locking mechanism is further rotatably or slidably mounted to the frame such that the user can choose the side for locking and the side for free operation.

15 Claims, 14 Drawing Sheets

(51) Int. Cl.
*E05B 63/04* (2006.01)
*E05B 65/00* (2006.01)
*E05B 3/00* (2006.01)
*E05B 37/00* (2006.01)

(52) U.S. Cl.
CPC ..... *E05B 65/0007* (2013.01); *Y10T 70/5788* (2015.04); *Y10T 70/722* (2015.04); *Y10T 70/7407* (2015.04); *Y10T 70/8865* (2015.04)

(58) Field of Classification Search
CPC .. E05B 37/163; E05B 37/166; Y10T 70/7407; Y10T 70/5788; Y10T 70/7215; Y10T 70/722; Y10T 70/7226; Y10T 70/7232; Y10T 70/8865
USPC ..... 70/214, 293, 297–300, 462
See application file for complete search history.

(56) References Cited

U.S. PATENT DOCUMENTS 2,846,255 A * 8/1958 Wardwell, Jr. ..... E05B 55/005 292/169.19
2,959,439 A * 11/1960 Russell ..... E05C 1/163 292/1
3,009,346 A * 11/1961 Check ..... E05B 37/16 70/150
3,343,387 A * 9/1967 Cochran ..... E05B 13/001 70/424
3,636,742 A * 1/1972 Raney ..... A47G 29/10 109/52
3,869,159 A * 3/1975 Eads ..... E05C 1/14 292/170
3,952,564 A * 4/1976 Maines ..... E05B 13/001 70/232
4,285,221 A * 8/1981 Atchisson ..... E05B 13/001 70/232
4,570,470 A * 2/1986 Gray, Sr. ..... E05B 13/001 70/212
4,631,938 A * 12/1986 Johnson ..... E05B 13/001 70/158
4,827,743 A * 5/1989 Kim ..... E05B 37/16 70/214
6,298,698 B1 * 10/2001 Nakajima ..... E05B 37/16 70/214
6,334,346 B1 * 1/2002 Wang ..... E05B 37/16 70/214
7,043,948 B1 * 5/2006 Wang ..... E05B 37/16 70/214
8,276,413 B2 * 10/2012 Talpe ..... E05B 37/16 70/214
9,347,241 B1 * 5/2016 Peng ..... E05B 37/16
2002/0088256 A1 * 7/2002 Taylor ..... E05B 37/16 70/25
2005/0086982 A1 * 4/2005 Nakazima ..... E05B 37/16 70/214
2005/0210937 A1 * 9/2005 Okuda ..... E05B 37/16 70/214
2015/0330105 A1 * 11/2015 Ng ..... E05B 37/16 70/22

FOREIGN PATENT DOCUMENTS

EP 1 118 739 B1 4/2005
EP 1 984 591 B1 4/2010
GB 2 176 233 A 12/1986

* cited by examiner

PUSHBUTTON COMBINATION LOCK

RELATED APPLICATIONS

The present application claims priority to European Patent App. No. EP13199105.1, filed on 20 Dec. 2013. The application referred to in this paragraph is incorporated by reference as if set forth fully herein.

TECHNICAL FIELD

The present invention relates to a pushbutton combination lock for gates and more particular to a pushbutton combination lock for locking the gate on one side only.

BACKGROUND ART

Pushbutton combination locks are known. Such a pushbutton combination lock is for example disclosed in GB-A-2 176 233. The lock disclosed in GB-A-2 176 233 comprises a series of pushbuttons on both sides of the lock so that from both sides the number combination can be entered to unlock the lock. From neither side of the door, the door can be freely opened so that the door or gate does not have to be completely closed to prevent access to the door handle on the other side of the door or gate. This is especially the case for outdoor doors or gates, such as garden gates or gates in fences. Although the lock comprises a series of pushbuttons on both sides, it comprises only one series of tumbler members and only one check slide. The pushbuttons on both sides of the lock act therefore onto the same tumbler members so that a same number combination has to be used on both sides of the lock. It is thus not possible to set one complex number combination on the outer side and a less complex combination on the inner side.

Another known pushbutton combination lock is disclosed in EP-B-1 984 591 of the applicant of this application. In this pushbutton combination lock two locking mechanisms are provided such that a first code can be chosen for the first side and a second code for the second side.

A disadvantage of both above described pushbutton combination locks is that a code has to be entered on both sides of the gate to be able to open the gate. EP-B-1 984 591 discloses in one of the embodiments of this patent a solution for this problem. The keyboard is on one side of the lock replaced by a keyboard with only one large pushbutton so that the lock can very easily be unlocked from one side of the door or gate. This solution still has the problem that the lock first has to be unlocked before the door or gate can be opened. Further, such a mechanism is expensive because a second locking mechanism is required. In some constructions, it's also possible to push the large pushbutton by a long bar or rod from the other side.

DISCLOSURE OF THE INVENTION

It is an aim of the present invention to provide a pushbutton combination lock which provides a solution for the above indicated problems.

This aim is achieved according to the invention with a pushbutton combination lock showing the technical characteristics of the first independent claim. The pushbutton combination lock comprises a frame, a lock bolt mechanism comprising a lock bolt movably mounted on the frame between a locking position and an unlocking position, a first lock bolt actuating mechanism arranged to move the lock bolt between the locking position and the unlocking position and a second lock bolt actuating mechanism arranged to move the lock bolt between the locking position and the unlocking position. The pushbutton combination further comprises a pushbutton combination locking mechanism mounted on the frame for locking the first lock bolt actuating mechanism to prevent the lock bolt from being moved by the first lock bolt actuating mechanism to the unlocking position, and independent from the second lock bolt actuating mechanism. The pushbutton combination lock is characterized in that the pushbutton combination locking mechanism is arranged to be selectively mounted on the frame in a first pushbutton position or a second pushbutton position, wherein in said first pushbutton position said pushbutton combination locking mechanism is operable from a first side of the lock and in said second pushbutton position said pushbutton combination locking mechanism is operable from a second side of the lock opposite to the first side of the lock.

The pushbutton has the advantage that the user can mount the locking mechanism (and thus the locking) on the desired side of the door or gate to which the lock is or will be mounted. Another advantage is that this lock will be cheaper because of fewer components than other mechanisms. Such a pushbutton lock is especially useful if the door or gate requires no or difficult access in one direction and at the same time frequent or easy access in the opposite direction.

In a further embodiment of the invention, the pushbutton combination lock comprises a first operating means reversibly mounted in the first lock bolt actuating mechanism for operating the first lock bolt actuating mechanism and a second operating means reversibly mounted in the second lock bolt actuating mechanism for operating the second lock bolt actuating mechanism.

The advantage of having operating means which is reversible is that the user can mount the operating as desired. If the locking mechanism is at a first side the first operating means can be mounted to be operable on the first side and the second operating can be mounted to be on the second side. If however the locking mechanism is at the second side, the first operating means can be mounted to be operable on the second side and the second operating can be mounted to be on the first side. The result is that locked and free access can be provided by the same lock on the sides as desired.

In another embodiment of the invention, the pushbutton combination locking mechanism is rotatably mounted on the frame from the first pushbutton position to the second pushbutton position by rotation around an axis located parallel to the lock bolt and in a plane substantially in the middle between the first and second sides of the lock.

This has the advantage that the pushbutton locking mechanism has not to be disassembled from the frame. The mechanism can remain on the frame and can be simply rotated.

In one embodiment of the invention the first lock bolt actuating mechanism comprises a first lever arranged to act on the lock bolt, and the second lock bolt actuating mechanism comprises a second lever arranged to act on the lock bolt, and the first lever and second lever are arranged such to act on the lock bolt independently.

The effect of having both levers acting independently on the lock bolt guarantees unlocked access by using the second lock bolt actuating mechanism.

In a further embodiment of the invention the first lock bolt actuating mechanism is arranged to rotate about a first axis of rotation, and said second lock bolt actuation mechanism is arranged such that operation by said second operating means rotates a first part of the second lock bolt actuating mechanism about a second axis of rotation and the second lever about the first axis of rotation.

By using the axis of rotation of the first actuating mechanism for the lever of the second actuation mechanism has the advantage that the same amount of rotation of the second actuation mechanism is needed to move the lock bolt as the amount of rotation for the first actuating mechanism to move the lock bolt.

In another embodiment of the invention, the frame comprises a cover box with two pairs of grooves and a top cover with a fixed top cover part and a lid. The fixed top cover part comprises a pair of walls selectively mountable in the first pair of grooves or in the second pair of grooves such that the lid is selectively at the first or second side of the lock.

By this structure, the lid can be easily configured to align with the side where the locking mechanism is desired.

In a further embodiment of the invention, the lock comprises a keyboard for operating the pushbutton combination locking mechanism, wherein the keyboard is selectively mountable in the first pair of grooves or in the second pair of grooves corresponding to the side where the pushbutton combination locking mechanism is mounted.

By using the same grooves for mounting the keyboard and the top cover, once the keyboard is positioned corresponding to the selected position of the locking mechanism, the top cover can only be mounted such that the lid is on the correct side. This avoids wrong assembly of the top cover. Further, this structure with grooves used for keyboard or top cover depending on the desired side of the locking results in a less complex cover box.

In a further embodiment of the invention, the frame comprises a basic frame to which the pushbutton combination locking mechanism is rotatably mounted and a side top cover, such that when the top cover, the basic frame and the side top cover are mounted on the cover box, a closed housing is formed in which the pushbutton combination locking mechanism is mountable in the two pushbutton positions.

This structure protects the pushbutton combination locking mechanism from any access from outside resulting in a very robust and safe lock.

In one embodiment of the invention, the pushbutton combination locking mechanism comprises a check slide mover movably mounted to the frame, wherein the check slide mover is arranged to block or release said first lock bolt actuating mechanism depending on the pushbutton combination pressed on the pushbutton combination locking mechanism.

The robust construction of the check slide mover ensures a reliable linkage between the locking mechanism and the actuating mechanism.

In a further embodiment of the invention, the pushbutton combination locking mechanism comprises at least one mounting member for rotatably mounting the pushbutton combination locking mechanism on said frame.

The mounting member ensures that the locking mechanism is in both positions reliably connected to the frame.

In another embodiment of the invention the frame is arranged to define the first pushbutton position and the second pushbutton position of said pushbutton combination locking mechanism.

This is another structural feature ensuring reliability and accuracy of the lock.

In still another embodiment of the invention, the pushbutton combination locking mechanism is fixed to the frame when mounted in the first pushbutton position or in said second pushbutton position.

This guarantees a reliable positioning of the locking mechanism in both positions with respect to the frame.

In one embodiment of the invention, the frame comprises a fixed shaft and the at least one mounting member is rotatably mounted on the shaft.

This structure allows a very robust rotational connection of the locking mechanism with respect to the frame.

In one embodiment of the invention, the check slide mover is slidably mounted on said shaft.

This is again a structural element which contributes to a simple, robust, reliable and cost effective structure.

In one embodiment of the invention the pushbutton combination locking mechanism comprises two mounting members on opposite sides of the locking mechanism both rotatably mounted to the shaft.

In another embodiment of the invention, the second operating means comprises a push handle with an axis of rotation perpendicular to an axis of rotation of the second lock bolt actuating mechanism when operated by said second operating means.

The lock with a push handle on the unlocked side is especially useful for emergency exits.

BRIEF DESCRIPTION OF THE DRAWINGS

The invention will be further elucidated by means of the following description and the appended figures.

MODES FOR CARRYING OUT THE INVENTION

Figure 1:
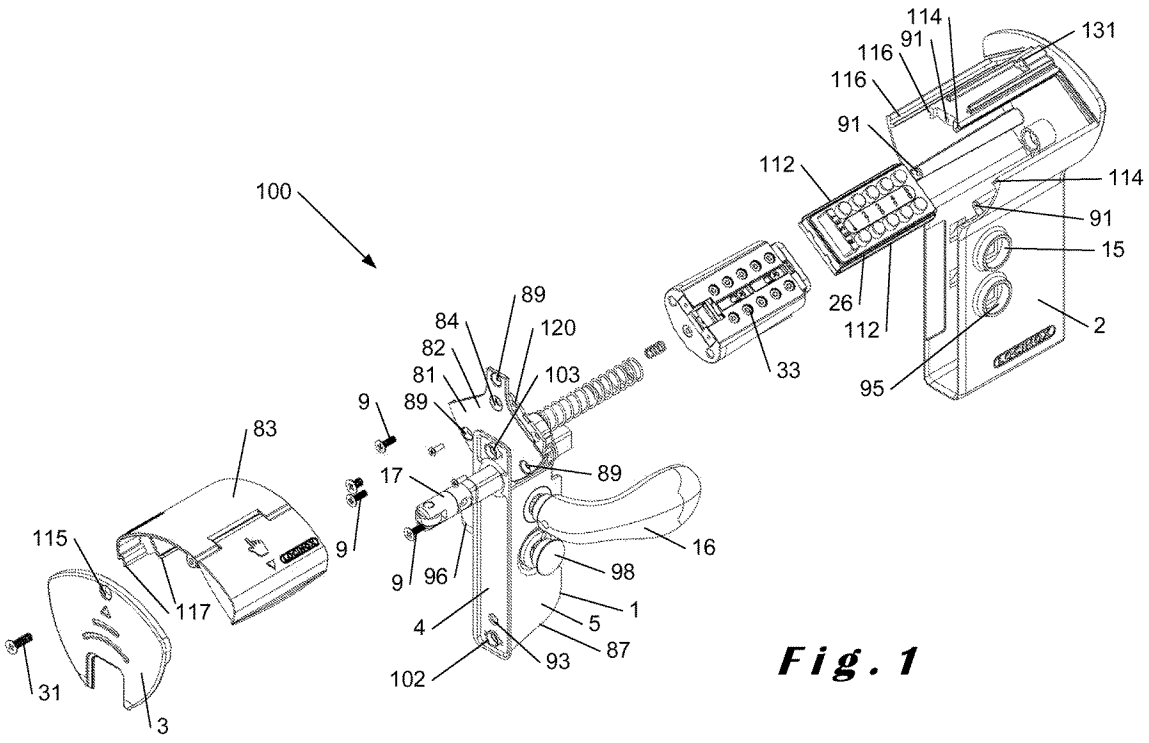
FIG. 1 shows an exploded view of a pushbutton combination lock according to an embodiment of the invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

FIG. 1 illustrates a pushbutton combination lock 100 according to an embodiment of the invention. The pushbutton combination lock 100 is a lock to be mounted against a profile, in particular a tubular profile, of a gate, fence, door, etc. The profile has to be provided with holes corresponding to holes 102, 103 of a base frame 87 and lock bolt 17. When the lock is mounted alternatively so that the lock bolt does not have to extend through a profile, the length thereof can of course be reduced.

The lock illustrated comprises a frame 1 which includes as main structural elements a base plate 5, a side cover 4, a support plate 81, a cover box 2, a side top cover 3 and a top cover 83. The side cover 4 and the support plate 81 are mounted to the base plate 5 forming a base frame 87, and the base plate 5 is arranged within the cover box 2 forming the majority of the outside housing. The housing is completed by the side cover 4 and the top cover 83. The top cover 83 has two parts: a first part for mounting to the cover box 2 and a lid. The top cover is made symmetrical such that is can be mounted in the cover box 2 in two positions: one with the lid to the one side and the other with the lid to the other side. This will be illustrated in more detail below. The base plate 5 has on one side an upstanding edge 6 and on its other side three upstanding edge portions 7, 8, 85 as can be seen for example on FIG. 14. The support plate 81 has three holes 89 to fix it to the upper portion of the cover box 2 into three corresponding holes 91 by means of screws 9. The lower, substantially rectangular side cover plate 4 is fixed to the cover box 2 through hole 93 into a hole on a corresponding projection (not visible on the Figures) provided inside the cover box 2 by means of a screw. By the connection of the support plate 81 and the side cover plate 4 to the cover box, the base frame 87 is mounted to the cover box 2. In an alternative embodiment the support plate 81 is a part of the base plate 5.

The cover box 2 is provided with two pairs of aligned openings 15, 95 through which door handles 16, 96 can be mounted. The first pair of aligned openings 15 is positioned above the second pair of aligned openings 95. In the first pair of aligned openings is provided on a first side of the lock a handle 16 and on the other side a closure member 97 (shown for example in FIG. 2). The closure member 97 is made of one part with a square handle shaft. The closure member 97 is mounted into or upto the opening 15 and on the other side the handle 16 is moved over the handle shaft until the handle 16 is also in contact with the other of the pair of openings 15. The handle is fixed on the handle shaft with a screw.

When rotating the handle 16 relative to the cover box 2, the closure member 97 is rotating simultaneously.

The second pair of openings 95 is also arranged to receive a handle and a corresponding closure member. A closure member 98 made as one part with a square handle shaft is positioned in the opening 95. The closure member 98 is provided at the same side as the handle 16 of the first pair of openings 15. On the other side, a handle 96 is provided on the square handle shaft and fixed with a screw. Rotating the handle 96 will again rotate the closure member 98 simultaneously.

Figure 3:
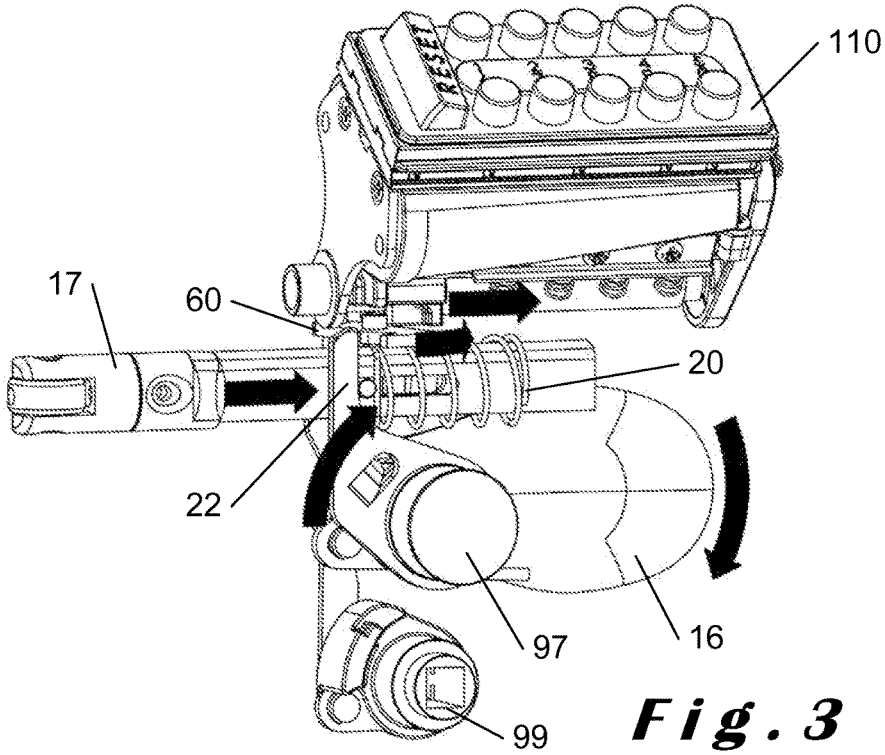
FIG. 3 shows the perspective view of FIG. 2 wherein the upper handle is reversed and is now accessible from the other side of the lock.
Figure 4:
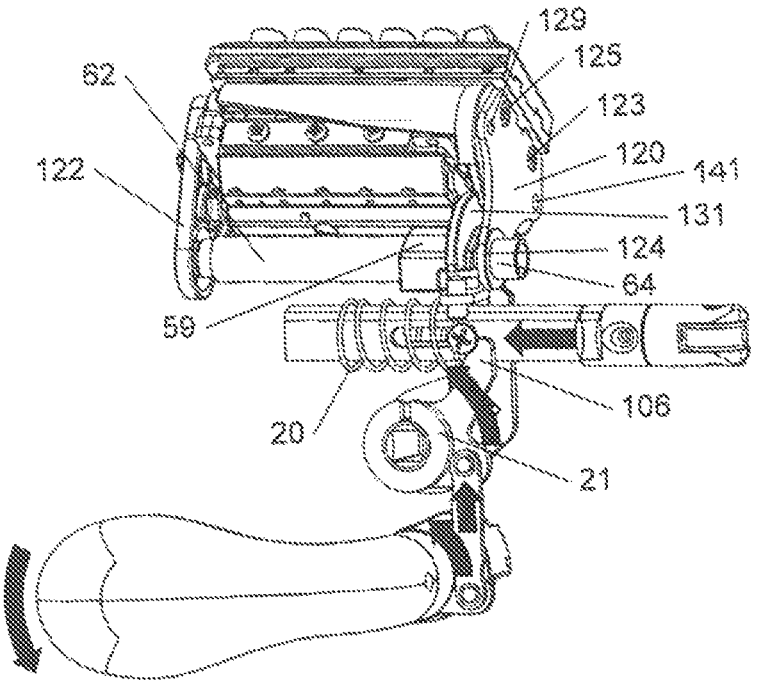
FIG. 4 shows a perspective view of the pushbutton combination lock of FIG. 1 with a number of components removed to illustrate how the second actuating mechanism with the lower handle is actuating the lock bolt.

The illustrated lock 100 further comprises a lock bolt 17 which is operated from the one side of the lock by means of the handle 16 and from the other side of the lock by means of the handle 96 to move it between a locking and an unlocking position as can for example be seen in FIGS. 3 and 4. The lock bolt 17 is in particular a latch bolt which is slidably mounted on the frame 1 of the lock, more particularly within an opening 18 in the upstanding edge portion 7 and an opening 19 in the upstanding edge 6 of the base plate 5. Openings 18 and 19 are shown for example in FIG. 14. The lock bolt 17 is biased in a projecting position (i.e. the most outside position) by a compression spring 20 provided over the latch bolt 17 and acting on the edge portion 7 and a projecting 24 on the latch bolt 2. The latch bolt 17 can thus move between a projecting position shown in FIGS. 3 and 4, and a retracted position when the compression spring 20 is compressed. In an alternative embodiment, the lock bolt is not moving in and out the frame to move between a locking and unlocking position, but the lock bolt is rotating about the axis of the lock bolt to move between a locking and unlocking position. This type of lock bolt is especially useful for sliding gates. For details of the structure of this lock bolt, reference is made to EP1336708 and the entire content of which is incorporated by reference.

Figure 2:
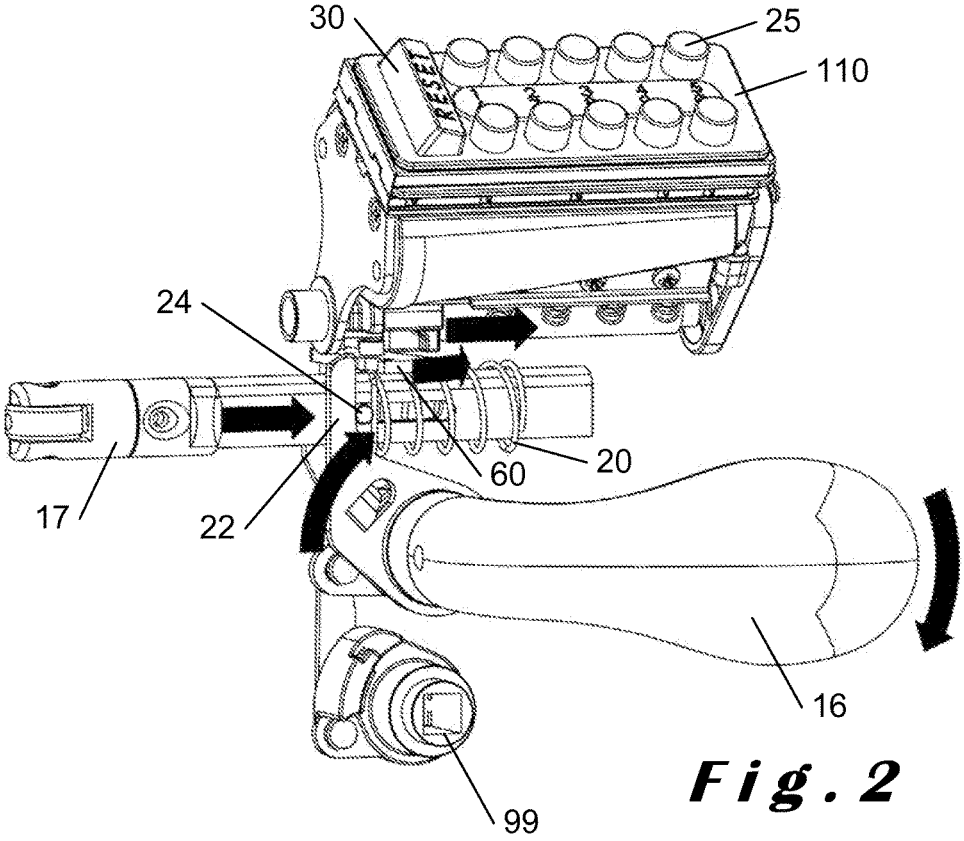
FIG. 2 shows a perspective view of the pushbutton combination lock of FIG. 1 with a number of components removed to illustrate how the first actuating mechanism with the upper handle is interacting with the pushbutton combination lock mechanism.

Referring to FIG. 2, for bringing the latch bolt 17 by means of the handle 16 to its retracted position, the square handle shaft of the closure member 97 is inserted in a corresponding hole in a follower 21 visible in FIG. 4. This follower 21 is provided in its turn with a latch bolt lever 22 which follows the rotations of the handle 16 and which engages the latch bolt 17 against the action of a torsion spring 23 acting on edge portion 8 and the latch bolt lever 22 to retract the latch bolt 17. Torsion spring 23 which is provided around the follower 21 is shown for example in FIG. 14. The torsion spring 23 acts such that it pushes the latch bolt lever 22 and thus the follower 21 and the handle 16 to their initial rest positions. The above described rotation of the handle 16 is only possible when the pushbutton combination mechanism is unlocked by pushing the correct combination. The other situation in which the rotation of the handle 16 is blocked by the pushbutton combination mechanism will be described in more detail below.

Figure 5:
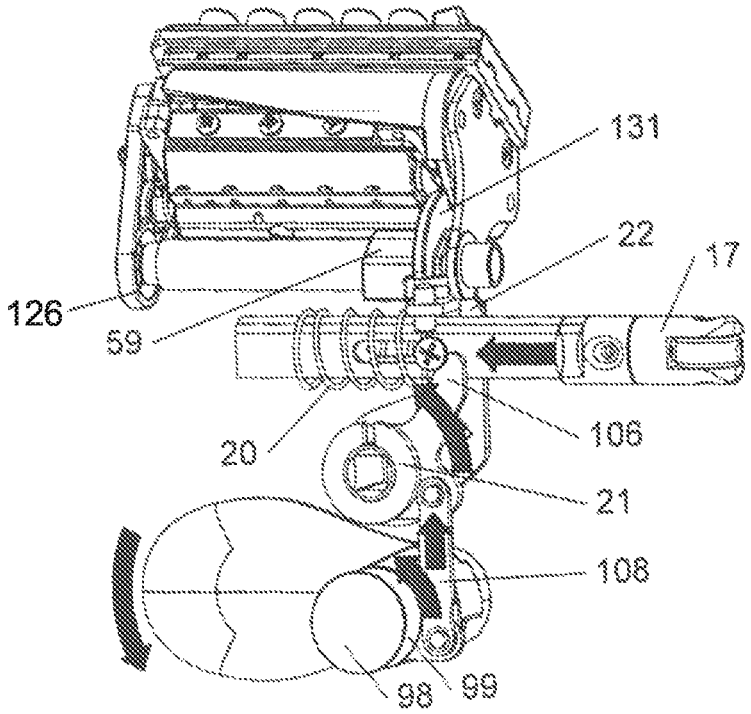
FIG. 5 shows the perspective view of FIG. 4 wherein the lower handle is reversed and is now accessible from the other side of the lock.
Figure 6:
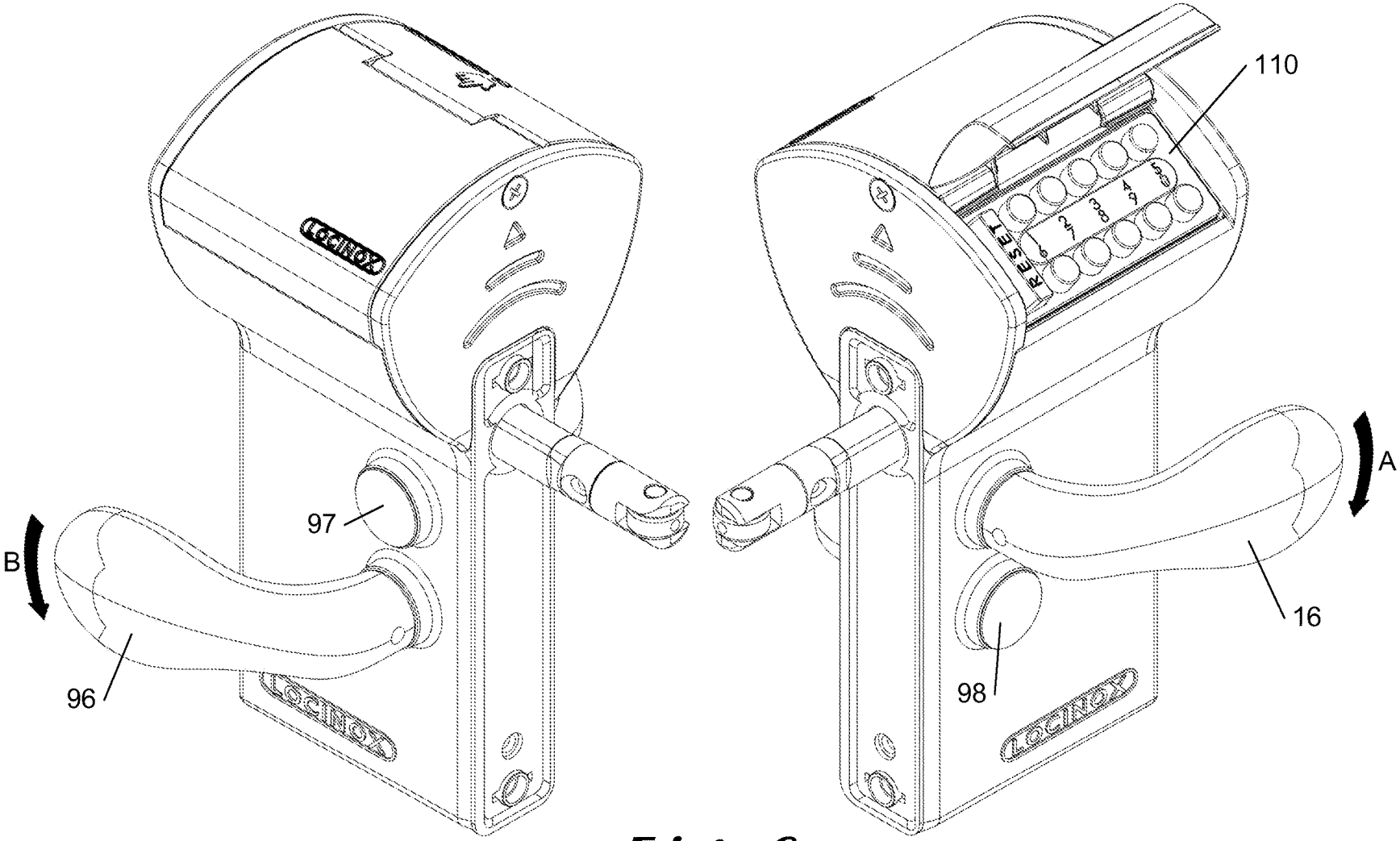
FIG. 6 shows a perspective view of both sides of the pushbutton combination lock according to an embodiment of the invention.

Referring to FIG. 4, the latch bolt 17 can also be brought in his retracted position by the second handle 96 provided on the opposite site of the lock with respect to the side where the first handle 16 is provided. This is illustrated in FIGS. 5 and 6. The square handle shaft of the closure member 98 is provided in a corresponding hole of a second follower 99. This follower 99 is in its turn connected with a second latch bolt lever 106 by an interconnection part 108. The follower 99 is rotating around the same axis of rotation of the second handle 96 (the lower axis of rotation), and the second latch bolt lever is rotating around the axis of rotation of the first handle 16 (the higher axis of rotation). The interconnection part ensures that when the second follower 99 rotates around the lower axis of rotation, the interconnection part 108 moves upwards, and the second latch bolt lever 106 rotates around the higher axis of rotation moving the latch bolt towards the retracted position. The second latch bolt lever 106 is acting against a second projection 24 of the latch bolt 17. The projection 24 is in this embodiment created by a screw. In an alternative embodiment this projection 24 can be created in other ways such as a pin. A torsion spring is provided around the second follower 99 acting against the rotation of the handle 96 when moving the latch bolt 17 towards the retracted position. The torsion spring acts in other words such that it pushes the second latch bolt lever 106, and thus the interconnection part 108, the follower 99 and the handle 96 to their initial rest positions.

The distance over which the latch bolt 17 of the lock 100 in the embodiment of the Figures projects out of the frame 1 is adjustable due to the fact that the latch bolt 17 is provided with a projection 24 which is slidably mounted in the latch bolt 17 and which can be displaced in the bolt 17 through the intermediary of a set screw. For more details about this adjustment mechanism, reference is made to EP-B-1 118 739, the entire content of which is incorporated herein by reference.

The lock 100 is provided with a pushbutton operated lock mechanism 110 for locking the lock bolt 17, in particular the latch bolt. The pushbutton operated lock mechanism 110 is provided on one side of the lock 100 and is interacting with the lock bolt actuating mechanism of the first handle 16. This means that the pushbutton operating lock mechanism 110 is locking the lock 100 on a first side but not on the other side opposite to the first side. On the other side, the lock 100 can still be operated by the lock bolt actuating mechanism of the second handle 96 as described above independent from the pushbutton operating lock mechanism 110. This is illustrated in FIG. 6 where the operation of arrow A is blocked unless the correct code is entered, and where the operation of arrow B is always possible. Further, when locked by this mechanism 110, the latch bolt 17 can still be moved to its retracted position when closing the door or gate, i.e. when pushing it in against the latch bolt spring 20. The locking mechanism 110 thus functions to prevent the lock bolt 17 from being moved by the lock bolt actuating mechanism of the upper handle 16 to its retracted or unlocking position. It does not prevent the lock bolt 17 from being moved by the lock bolt actuating mechanism of the lower handle 96.

The locking mechanism 110 comprises a series of pushbuttons 25 on the front or back side of the lock as illustrated on FIG. 2. The pushbuttons 25 are integrated in a keyboard 26 as described in detail in EP-B-1 984 591. Therefore, for more details about the internal structure of the keyboard 26, reference is made to EP-B-1 984 591, the entire content of which is incorporated herein by reference. The keyboard 26 also comprises a reset button 30.

Referring again to FIG. 1, the keyboard 26 has over his length two outwards projecting grooves 112 by means of which they can be slid in an upper, rectangular corresponding inwards grooves 114 in the cover box 2. The cover box 2 is further arranged such that the keyboard 26 can be slid into the cover box on both sides of the cover box 2 such that the user can choose on which side of the lock 100 the keyboard 26 and thus the pushbutton operated lock mechanism is needed. This reversible function of the lock 100 will be discussed in more detail below. For this function, a second pair of inwards grooves 116 is provided in the cover box 2 on the other side of the lock 100. The keyboard 26 is kept in the housing of the lock 100 by the side cover 3 which is mounted to the cover box 2 by a screw 31. The screw 31 is screwed in hole 131 of the cover box 2 through hole 115 of the side cover 3.

Figure 7:
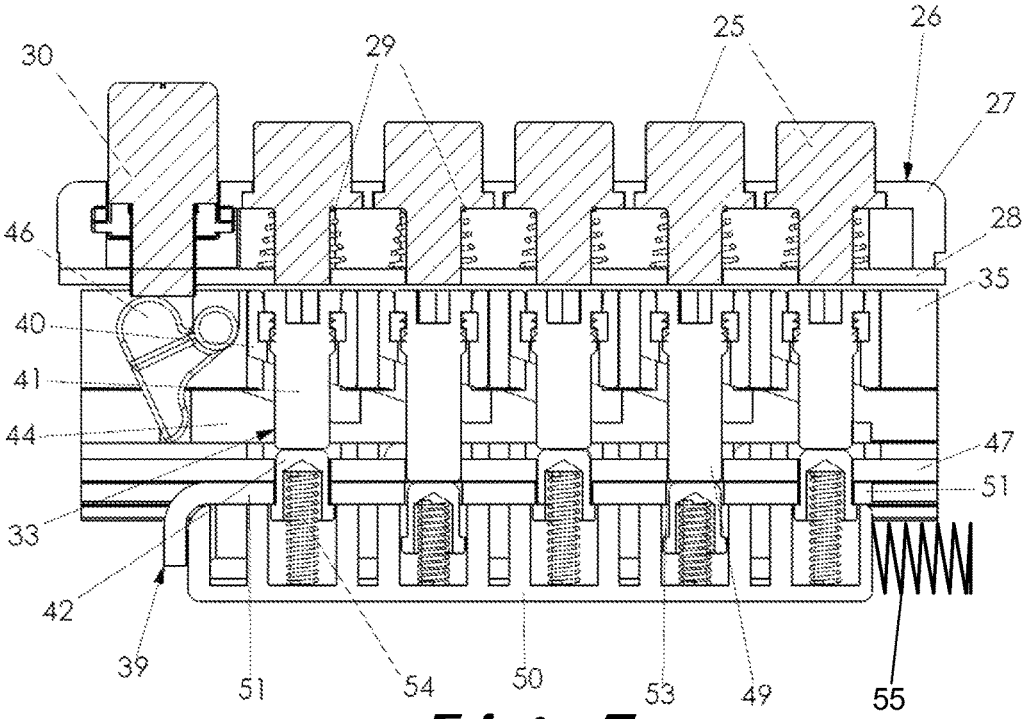
FIG. 7 shows a cross section through a portion of a pushbutton combination lock mechanism at the location of one row of pushbuttons of the keyboard, and the tumbler members and the check slide cooperating therewith, the tumbler elements being all in their rest or normal position.
Figure 9:
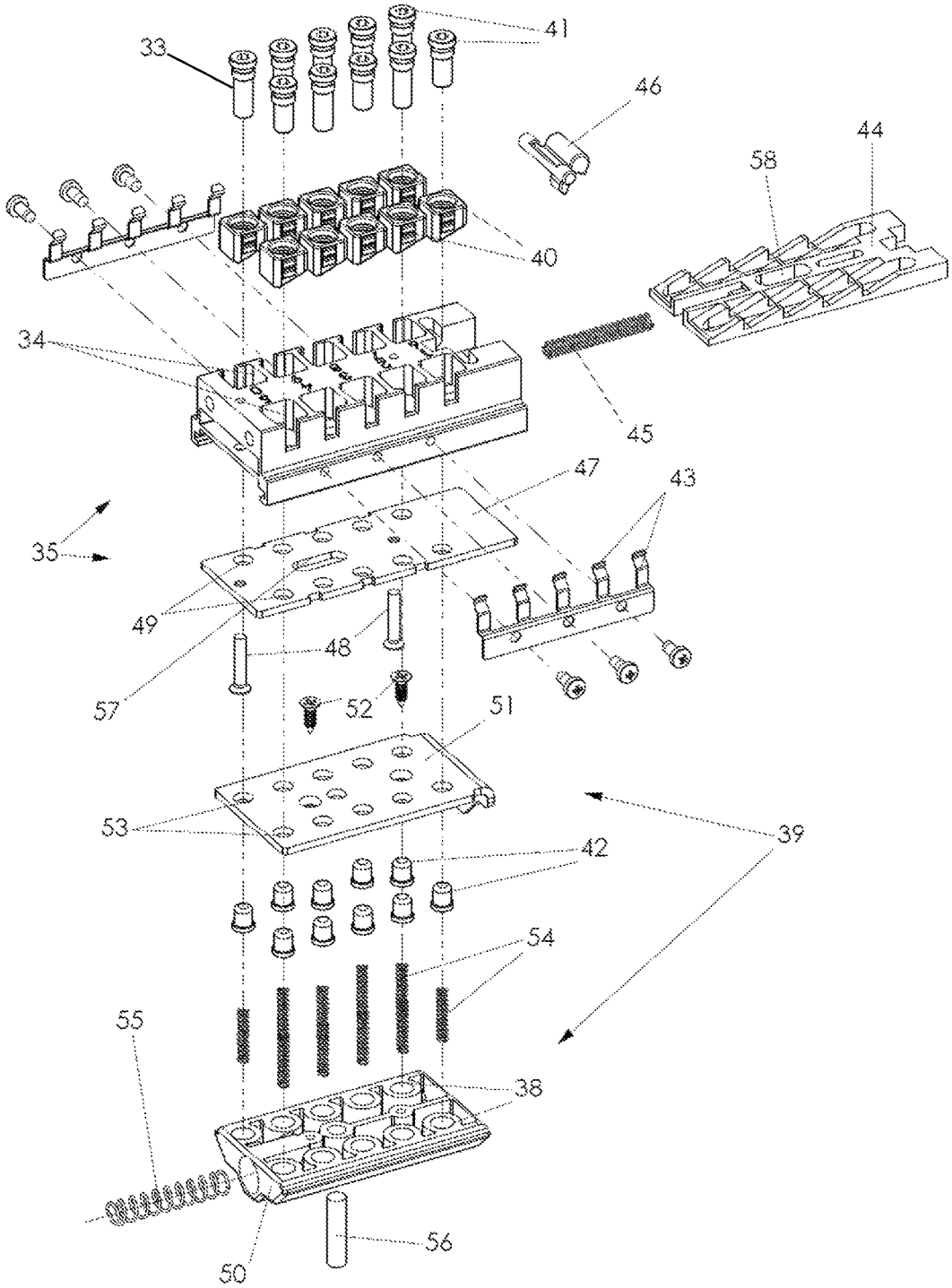
FIG. 9 shows an exploded view of a portion of a pushbutton combination lock mechanism.

The locking mechanism 110 further comprises a series of tumbler members 33 which are movable between normal and depressed stable positions by means of the series of pushbuttons 25 as is illustrated in FIG. 7. As shown in FIG. 9, the tumbler members 33 are arranged, on the one hand, in holes 34 in a frame component 35 and, on the other hand, in holes 38 in two check slides 39 which are slidably mounted on the frame component 35 as shown for example in FIG. 11. Depending on the positions of the tumbler members 33, the check slides 39 are either blocked or released with respect to the frame component 35 as will be discussed in more detail below.

Figure 8:
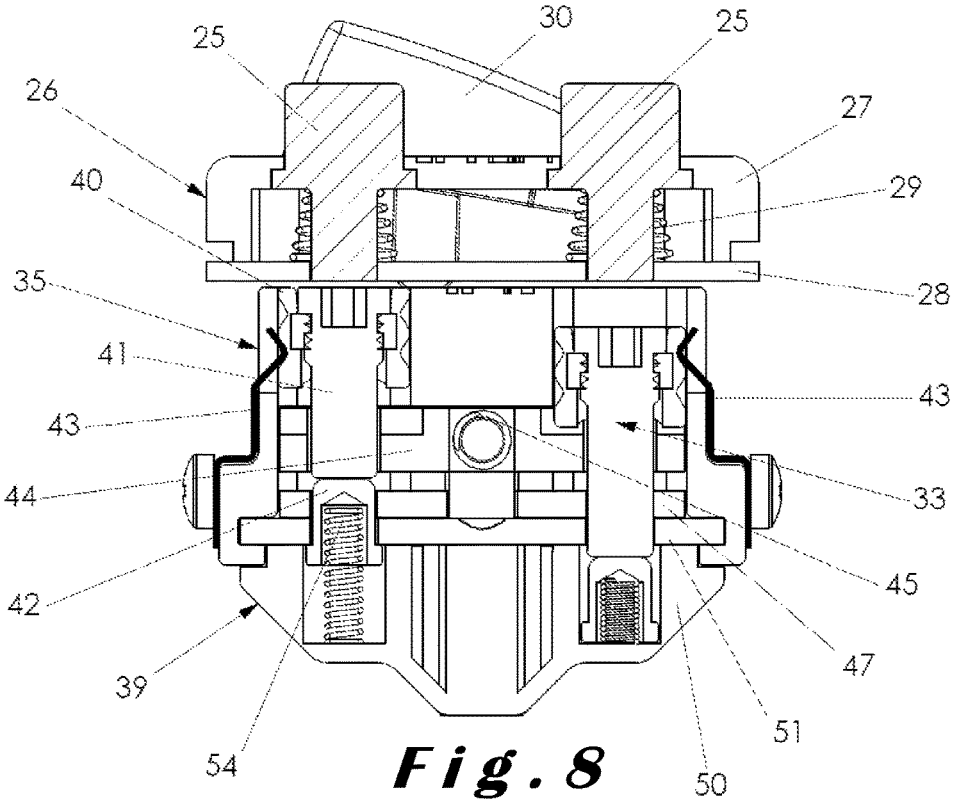
FIG. 8 shows a cross section through the same portion as FIG. 7 but taken in a direction perpendicular thereto.

Referring to FIG. 8, the tumbler members 33 each consist of a first tumbler element, composed of a base body 40 and a code body 41, and a second tumbler element 42. The base bodies 40 are slidably mounted in the holes 34 in the frame component 35. To be held in the two stable positions, the base bodies 40 each have two recesses on one lateral side which can be engaged by a spring detent 43, more particularly by leaf springs fixed against both sides of the frame component 35 and extending through slits therein into the holes 34. Instead of leaf springs, it is also possible to use spring detents comprising compression springs.

The code bodies 41 are of two different lengths and are removably fixed to the base bodies 40 to extend through axial holes provided therein. In one embodiment, the code bodies 41 can for example be snapped in the holes in the base bodies 40. However, in the preferred embodiment of the Figures, for example FIG. 8, the code bodies 41 are in the form of screws which can be screwed easily and reliably into the base bodies 40.

Figure 10:
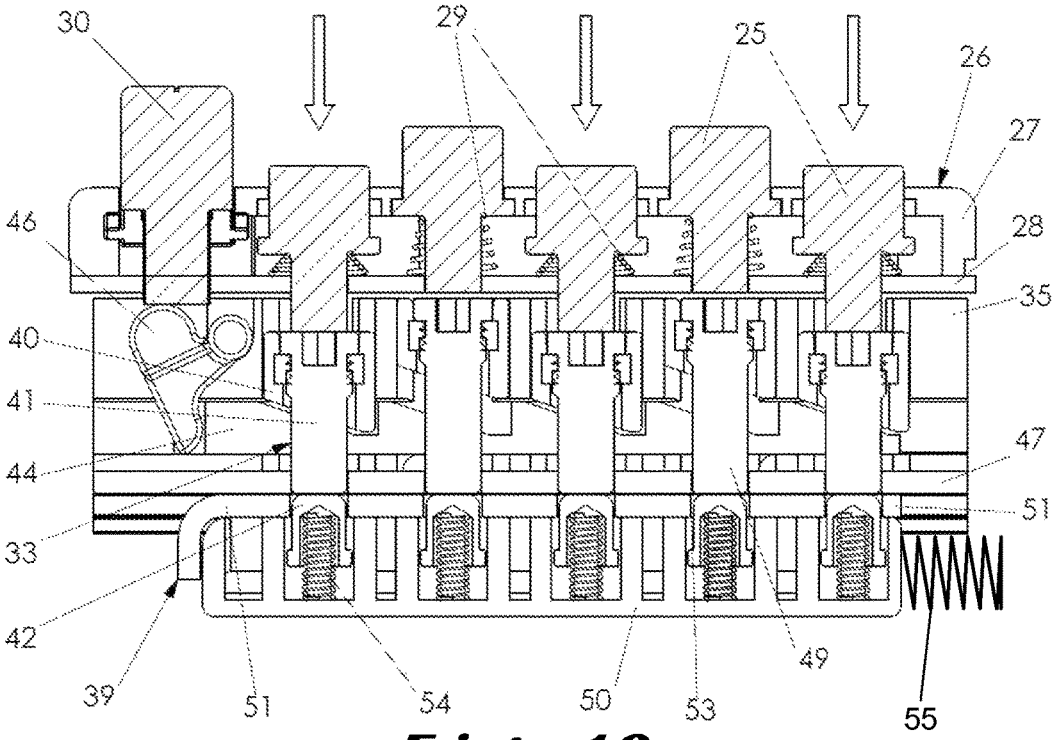
FIG. 10 shows the cross section of FIG. 7 illustrating the depressing of the code tumbler elements by means of the pushbuttons to release the check slide and to unlock thereby the lock.

Referring to FIGS. 8 to 10, to enable to reset the tumbler members 33 after being depressed by the pushbuttons 25, i.e. in order to enable to return the tumbler members 33 to their normal stable position, a reset slide 44 is provided in each of the frame components 35. This reset slide 44 is biased by means of a spring 45 to its rest position and can be moved by depressing of the reset button 30, through the intermediary of a lever 46, against the spring bias. The reset slide 44 is provided with oblique cam surfaces (forming a kind of saw tooth) engaging an oblique bottom surface of the base bodies 40 to lift the tumbler elements 40, 41 to their normal positions when the reset slide 44 is moved against the spring bias. At the underside the frame component 35 comprises a bottom plate 47 which is fixed to the main part of the frame component by means of screws 48. The bottom plate 47 is provided with openings 49 which are part of the holes 34 in the frame component 35 and which are arranged to receive and guide the lower extremities of the code bodies 41.

The check slides 39 are guided on the frame components 35 along the bottom plates 47 and comprise a main body part 50, forming part of the holes 38 for slidably receiving the second tumbler elements 42, and a top plate 51 fixed by means of screws 52 to the main body part 50. The top plate 51 shows openings 53 which are part of the holes 38 in the two check slides 39 and which are arranged to receive and guide the second tumbler elements 42. These second tumbler elements 42 are more particularly biased by means of springs 54 to project out of the openings 53 until a flange on the second tumbler elements 42 engages the top plate 51.

Referring to FIG. 7, the check slides 39 are biased by means of spring 55 to their first or rest position. The spring 55 is sitting on the other end of the spring over a projection on a mounting member 122 which will be discussed below in more detail. In that position the openings 49 in the bottom plate 47 (forming part of the holes 34 in the frame component 35) and the openings 53 in the top plate 51 (forming part of the holes 38 in the check slides 39) are situated opposite one another so that the second tumbler elements 42 are biased by means of the springs 54 against the first tumbler elements, more particularly against the code bodies 41 thereof. At least one of the first tumbler elements 40, 41 is a code tumbler element, which comprises a "short" code body 40 so that the corresponding second tumbler element 42 extends into the hole 34 in the frame component 35 to block the check slide 39 when all the tumbler members have been reset. The first tumbler elements 40, 41 may also comprise (and will normally comprise) one or more block tumbler elements, which comprise a "long" code body 40 having such a length that, in the reset position of the tumbler members, they push the corresponding second tumbler elements 42 into the holes 38 in the check slides 39, without projecting themselves into these holes 38. The block tumbler elements therefore do not block the reset slides when they are not depressed but they do block the reset slides when being depressed. In FIG. 7, all of the tumbler members 33 have been reset and the check slide 39 is in the blocked position.

Figure 11:
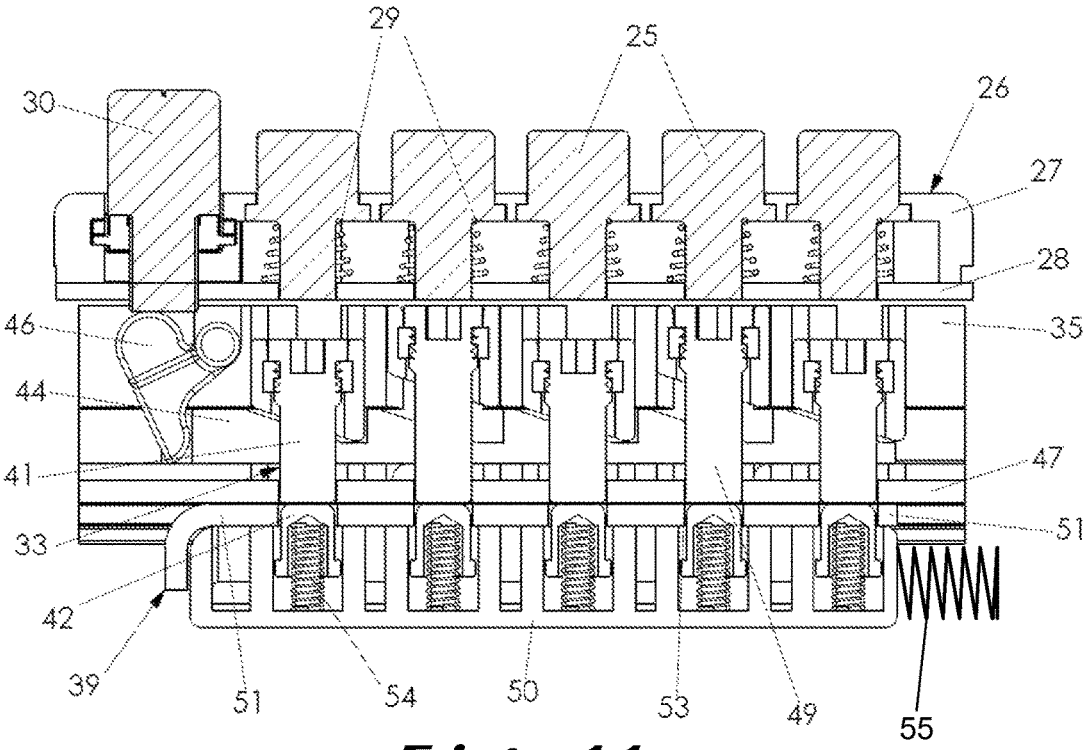
FIG. 11 shows the cross section of FIG. 7 illustrating the released check slide with the pushbuttons returned to their normal positions.
Figure 13:
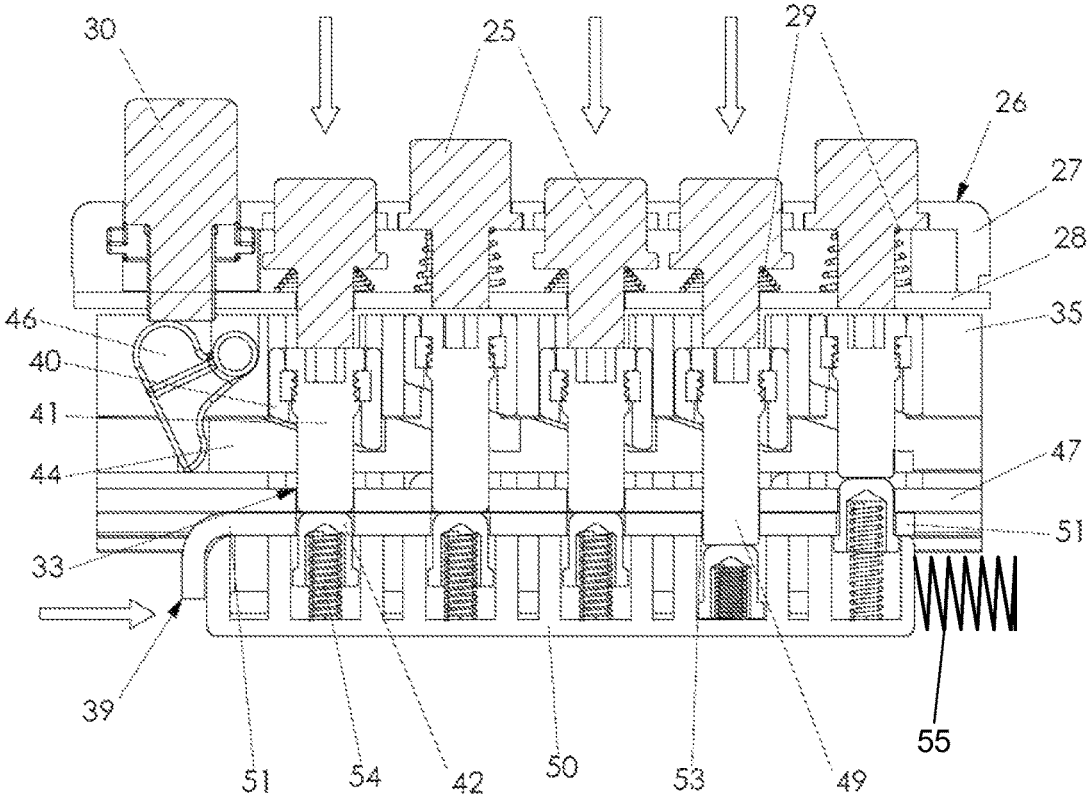
FIG. 13 shows also the cross section of FIG. 7 illustrating the check slide blocked by means of a first and second tumbler element after having used a wrong number combination.

Referring now to FIG. 10, the check slide 39 can be released by depressing only the code tumbler elements by means of the respective push buttons 25. Since the pushbuttons 25 return immediately back to their rest position when being released, the number combination required to release the check slide cannot be seen from the outside when the check slide has been released. This is illustrated in FIG. 11. Further, as can be seen in FIG. 13, when one of the block tumbler elements is wrongly depressed, it extends into the corresponding hole in the check slide and blocks the check slide. In this case, the tumbler members have to be reset all by means of the reset button 30 and the correct number combination has to be put in again.

Figure 12:
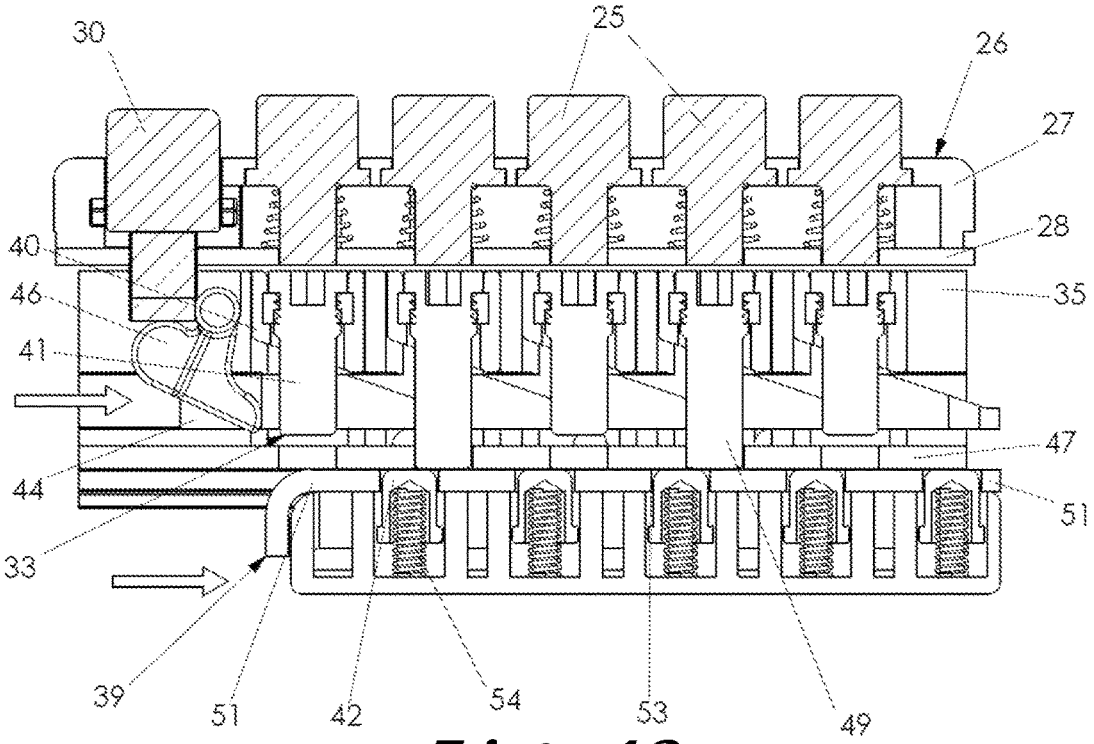
FIG. 12 shows again the cross section of FIG. 7 illustrating the movement of the released check slide from its first to its second position upon retracting the latch bolt by means of the latch bolt actuating mechanism and the simultaneous resetting of the tumbler members to their normal positions by the reset slide.

FIG. 12 illustrates the sliding movement of the released check slide 39 from its first normal position, against the bias of the spring 55, to its second position. It also illustrates that during this movement all of the tumbler members 33 are automatically reset by the reset slide 44, i.e. without having to operate the reset button 30. Once the door or gate has been opened and is closed again, it is thus automatically locked. Referring to FIG. 9, the automatic reset of the tumbler members 33 is achieved by means of the peg 56 which is fixed in a hole in the check slide 39. This peg 56 extends through a slit 57 in the frame component 35 (more particularly in the bottom plate 47 thereof) and through a slit 58 in the reset slide 44. In the normal rest position of the check slide 39, the peg 56 extends in the right end of the slit 57 and in the left end of the slit 58. The tumbler members 33 can thus be reset by moving the check slide 39, and at the same time the reset slide 44, to the left (when the check slide has been released by means of the right number combination) or by moving only the reset slide 44, by means of the reset button 30, to the left (which is possible even when a wrong number combination has been used so that the check slide is blocked).

Referring to FIGS. 4 and 5, the locking mechanism 110 further has a first mounting member 120 and a second mounting member 122. The first mounting member 120 is connected with two screws 123, 125 to the frame component 35 and has a hole 124 to move it over a shaft 62 which is fixed to the base plate 5 by fixedly connecting the top part 64 of the shaft 62 to the base plate 5. The second mounting member 122 is connected with two screws to the other side of the frame component 35. The second mounting member has a hole 126 which will also be positioned over the shaft 62. In that way the whole locking mechanism 110 can rotate around the axis of the shaft 62. Further, as can be best seen in FIG. 1, the support plate 81 is mounted fixed to the shaft 62 and the base plate 5, and is aligned with upstanding portion 6 of the base plate 5. The support plate 81 has outwards projecting walls on the opposite surface of surface 82 (shown on FIG. 1) defining end positions for the locking mechanism 110 when rotated around the shaft 62. The support plate 81 further has a hole 84 which is corresponding with one of the holes 141, 129 in the first mounting member 120 as shown in FIG. 4. In a first end position, the hole 84 of the support plate 81 is corresponding to hole 129 of the first mounting member 120 and the position of the locking mechanism 110 with respect to the base plate 5 and thus with respect to the frame 1 can be fixed by providing a screw 127 through hole 84 of support plate 81 in to the hole 129 of the first mounting member 120.

In order to enable to unlock the locking mechanism 110 with the pushbuttons 25 on the front side or the back side of the lock 100, the lock according to the invention comprises a check slide mover 59 which can be best seen for example in FIG. 4. The check slide mover 59 has a wall 131 perpendicular to the axis of the shaft and with a side concentric with the shaft 62. The wall 131 fits in a groove of the lock mechanism 110 such that the check slide mover 59 is arranged to interact with the top plate 51 of the check slides 39 in both end positions of the locking mechanism 110. Thus if the locking mechanism is positioned and fixed in the front side of the lock 100, the check slide mover 59 is blocked or released by the first and second check slides 39, and if the locking mechanism is positioned and fixed in the back side of the lock 100, the same check slide mover 59 is blocked or released by the first and second check slides 39. This structure has the advantage that a single locking mechanism can be selectively used on the one or the other side of the lock so that a same lock can be used both for left and for right turning doors.

Further, the check slide mover 59 couples the blocked or released check slides to the lock bolt mechanism, i.e. either to the bolt itself or to the lock bolt actuating mechanism. In the preferred embodiment illustrated in the figures, the check slide mover 59 is coupled to the latch bolt actuating mechanism so that when the tumbler members are automatically reset after having opened the door or gate (and the check slide is thus blocked again), the door or gate can still simply be closed without having to put in the right number combination again.

Figure 14:
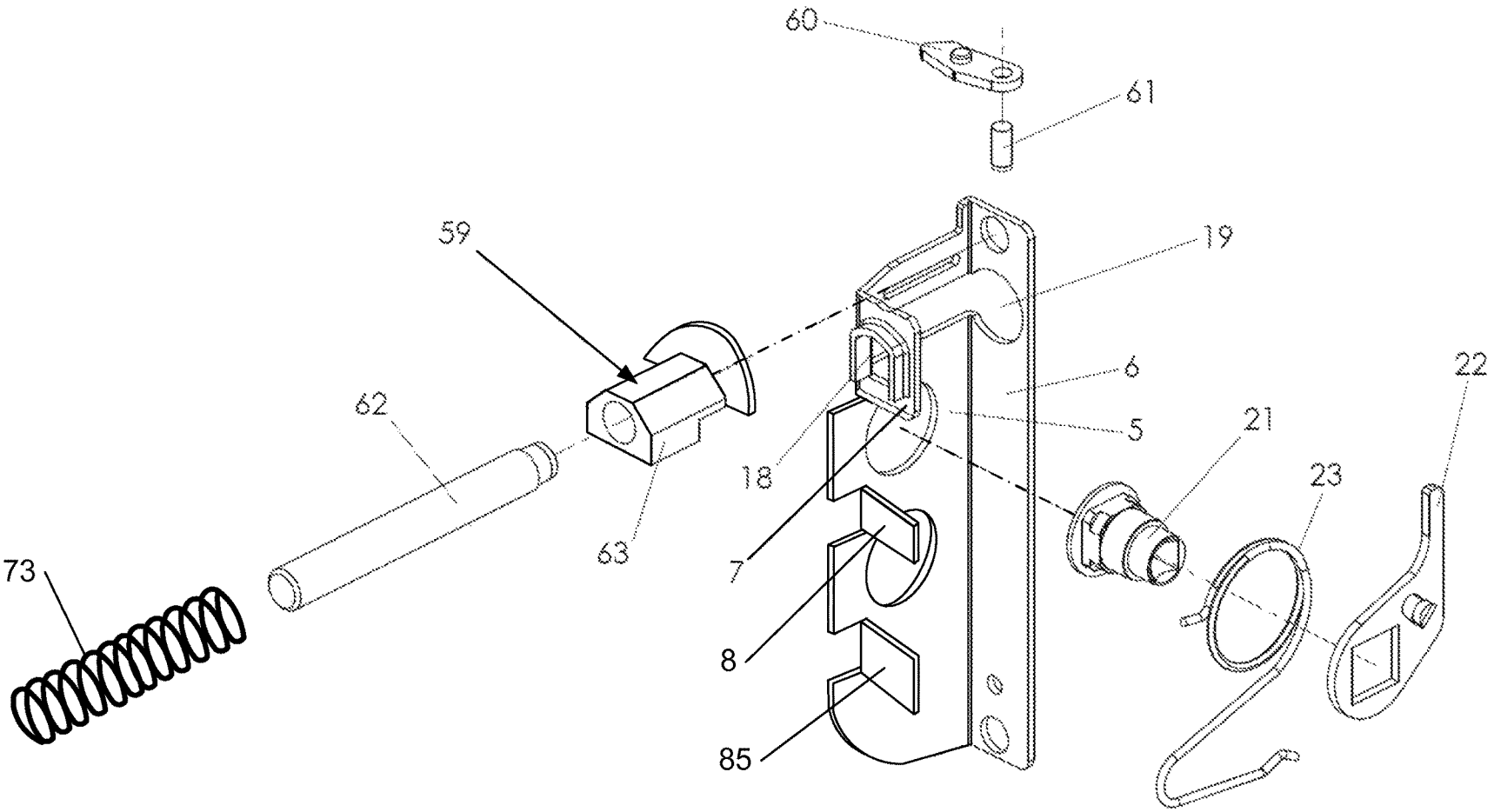
FIG. 14 is an exploded view of some components of the pushbutton combination lock according to an embodiment of the invention illustrating some frame elements and some elements interacting with the frame.

Referring to FIGS. 2 and 14, the latch bolt lever 22 does not only act upon the projection 24 on the latch bolt 17 but extends further to engage a lever 60 which is pivoted about a pivot 61 fixed to the frame. The latch bolt lever 22 engages the lever 60 at a first distance from the pivot 61. The lever 60 itself engages the check slide mover 59 at a second distance from the pivot 61 which is smaller than the first distance. In this way, the displacement of the check slide mover 59 is reduced so that a smaller force has to be exerted onto the latch bolt lever 22 and so that especially the locking mechanism 110 can be made more compact as will appear hereafter (the holes in the check slides 39 can be made closer to one another due to the smaller displacement of the check slides). It is clear that, instead of using the latch bolt lever 22 to engage the lever 60 or the check slide mover 59, an additional lever can be provided therefore on the latch bolt actuating mechanism.

As can be best seen in FIG. 14, the check slide mover 59 is slidably mounted on the frame, more particularly onto the shaft 62 having one end fixed to the upstanding edge 6 of the base plate and the other end mounted fixed to the cover box 2 by moving the shaft 62 into a hollow projection on the inside of the cover box 2. The check slide mover 59 comprises a main body part 63 with a hole to move over the shaft 62 and a wall perpendicular to the axis of hole of the main body part 63. The wall has a side concentric with the shaft 62 when mounted on the shaft 62.

In this way, when the check slides 39 are blocked, the check slide mover 59 cannot move along the shaft 62 and blocks the lever 60 and thereby also the latch bolt lever 22 so that the latch bolt actuating mechanism is locked. When the check slides 39 are however released by unlocking of the lock on the side of the lock where the lock is provided, the check slide mover 59 can move along the shaft 62 and therefore the lever 60 and thereby also the latch bolt lever 22 can move so that the latch bolt actuating mechanism is released.

Figure 15:
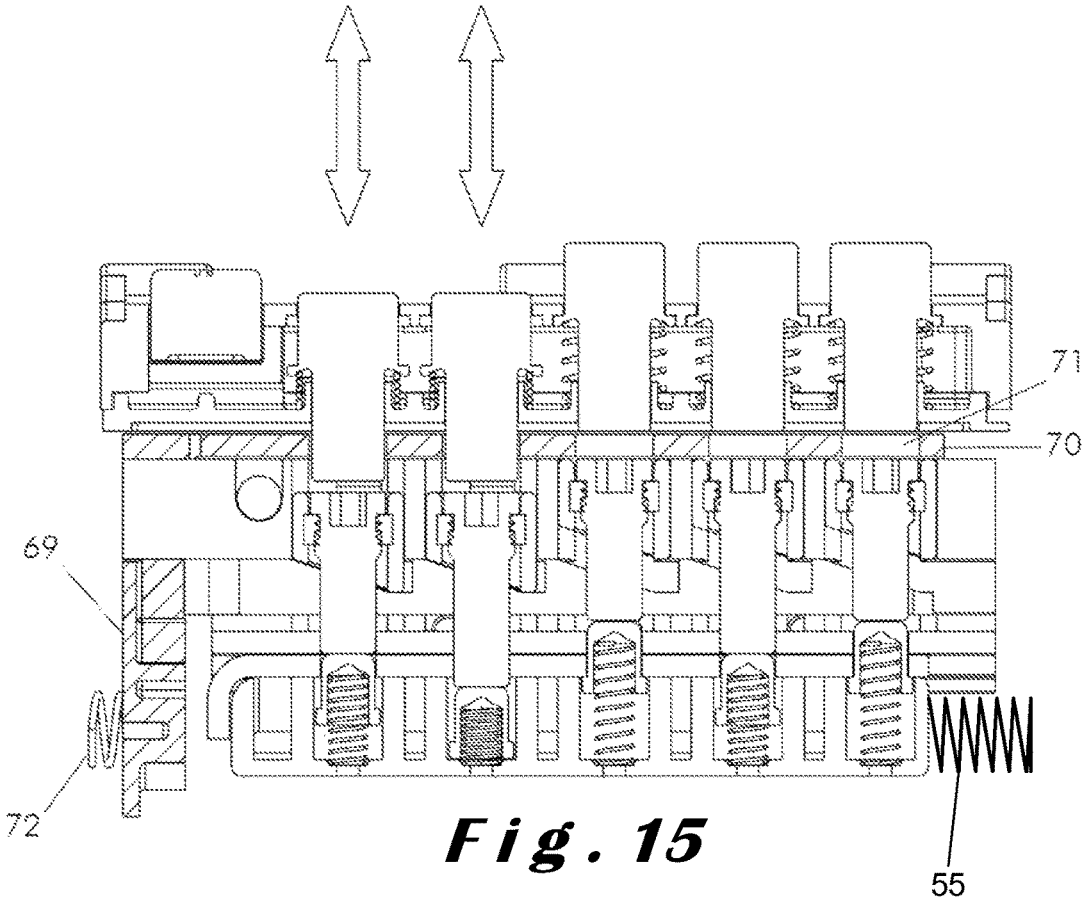
FIG. 15 shows a similar cross section as FIG. 7 through a portion of an alternative pushbutton combination lock mechanism with a security slide according to an embodiment of the invention with the security slide in his rest position.
Figure 16:
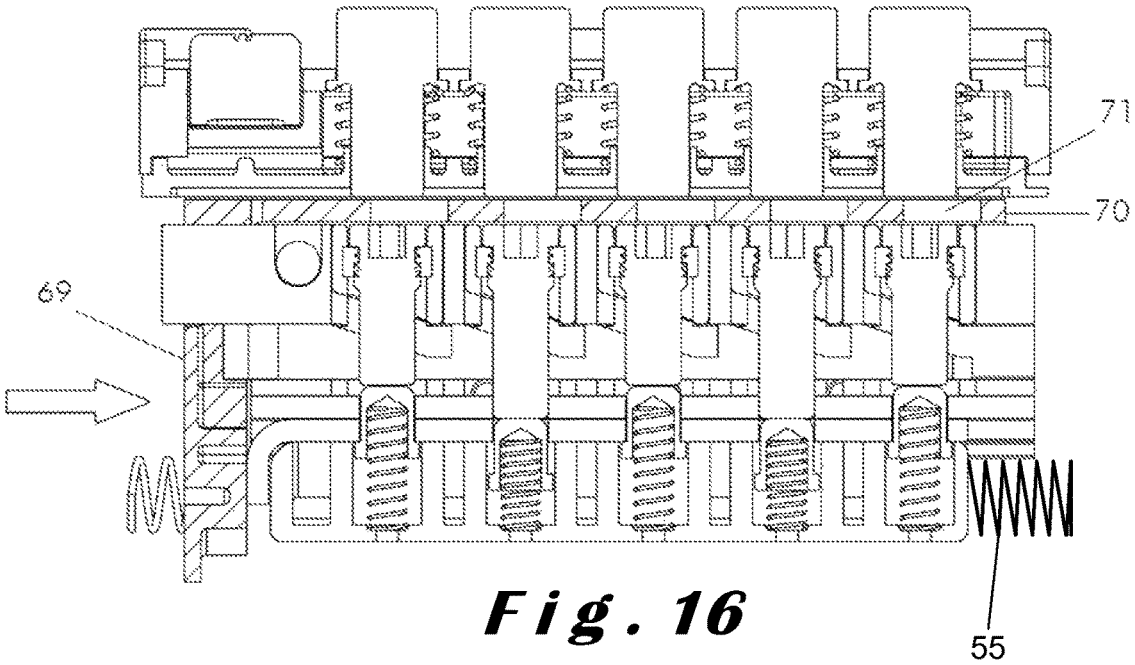
FIG. 16 shows the view of FIG. 15 with the security slide moved.

Referring to FIGS. 15 and 16, in an alternative preferred embodiment, the locking mechanism 110 incorporates a security slide 69 to protect the lock code. In the illustrated embodiments of FIGS. 7 to 13, there is a danger that, by depressing the lock handle 16 before the pushbuttons 25, it may be possible to slightly displace the check slide 39, so that it opposes a greater resistance to depressing the "long" code bodies 40 than the "short" code bodies 40 or vice versa, depending on the shape of the lowermost extremities of the "long" code bodies 40. This would enable an intruder to pick the lock code. In order to avoid this, the security slide 69 is also linked to the lock handle 16 through the follower 21, latch bolt lever 22, lever 60 and check slide mover 59, so that, when the lock handle 16 is depressed, the security slide 69 will be displaced from a first position to a second position. To enable this relatively small displacement, a small distance is provided between the check slide mover 59 and the check slides 39. The security slide 69 comprises a plate-like portion 70 which is interposed between said first series of pushbuttons 25 and said first series of tumbler members 33, and which comprises a first series of holes 71 corresponding to the first series of pushbuttons 25. In the first position, the holes 71 are aligned between the pushbuttons 25 and the tumbler members 33, allowing said pushbuttons 25 to engage said tumbler members 33 when depressed. When however the security slide 69 is displaced to the second position illustrated in FIG. 16, the holes 71 are no longer aligned, and the plate 70 locks the pushbuttons 25 in their normal position, out of engagement with the tumbler members 33. The pushbuttons 25 can therefore only be depressed when the lock handle 16 is released.

In the embodiment of FIG. 15, the security slide 69 is held in the first position by the check slide mover 59, more particularly under the bias of a relatively strong coil spring 73, shown in FIG. 14 and mounted over the shaft 62, and biased towards the second position by a less strong spiral spring 72. In this way, if the check slide mover 59 moves slightly due to actuation of the lock handle 16, the coil spring 73 is compressed and the coil spring 72 urges the security slide 69 to its second position as illustrated in FIG. 16. Alternatives to this arrangement, such as using a leaf spring instead of spiral spring 72 or a different coupling with the lock bolt actuating mechanism are within the reach of the skilled person.

Referring to FIGS. 18 to 21, the process will be described to reverse the lock 100 from a locking mechanism 110 and an upper handle 16 on a first side (e.g. front side), and a lower handle 96 on a second side (e.g. back side) to the lock 100 with the locking mechanism 110 and the upper handle 16 on the second side and the lower handle 96 on the first side. This allows the user to use the same lock for a door or gate of which the locking has to be foreseen on the one side or the other. If the side of the locking is not as desired, the user can easily reverse the lock to be locked at the desired side.

Figure 17:
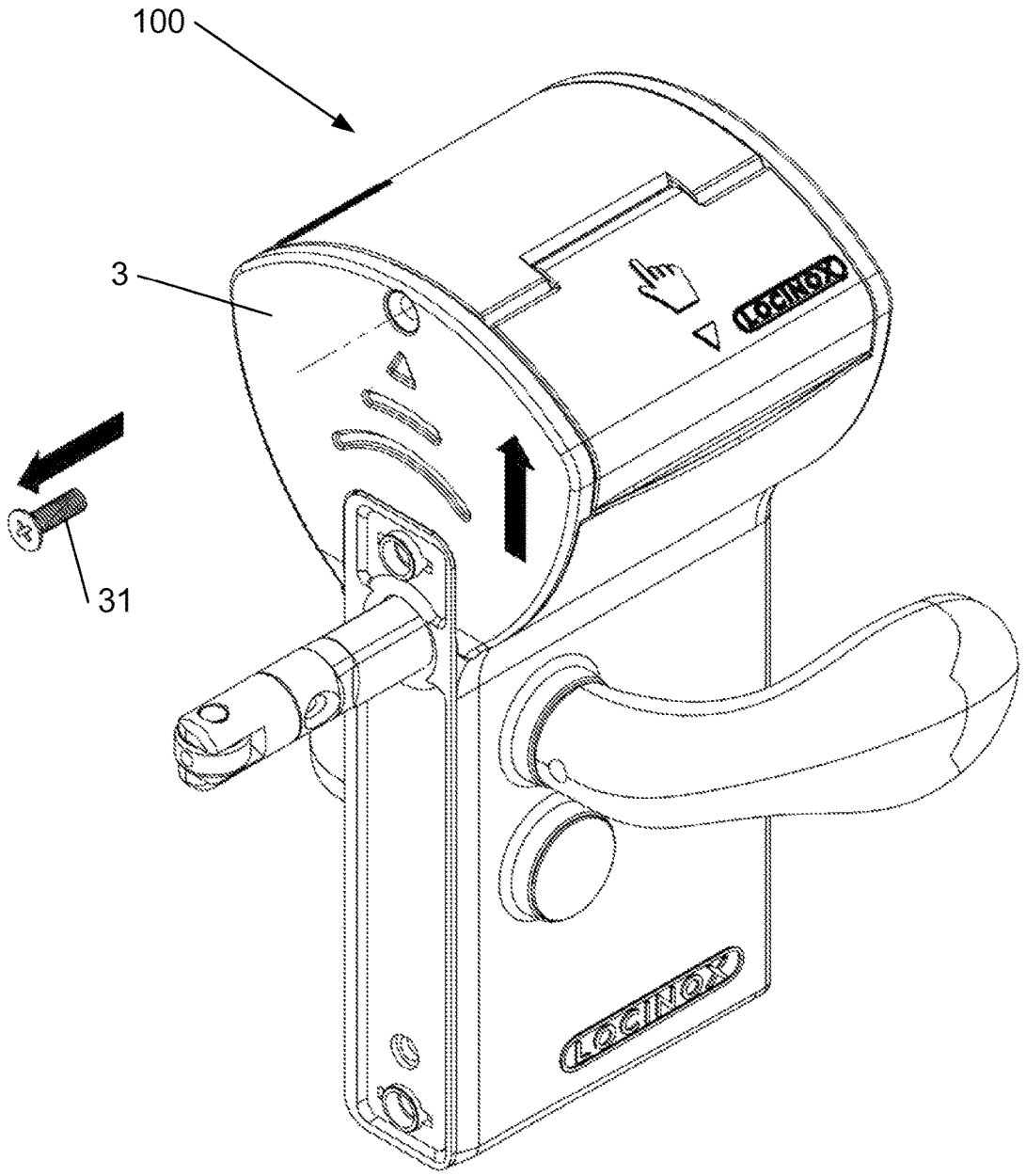
FIG. 17 shows a perspective view of the pushbutton combination lock according to an embodiment of the invention illustrating the first steps in the process to reverse the lock to have the pushbutton combination lock on the other side of the lock.

FIG. 17 illustrates the first steps. In the first step screw 31 is removed which allows to remove the side cover 3 from the lock.

Figure 18:
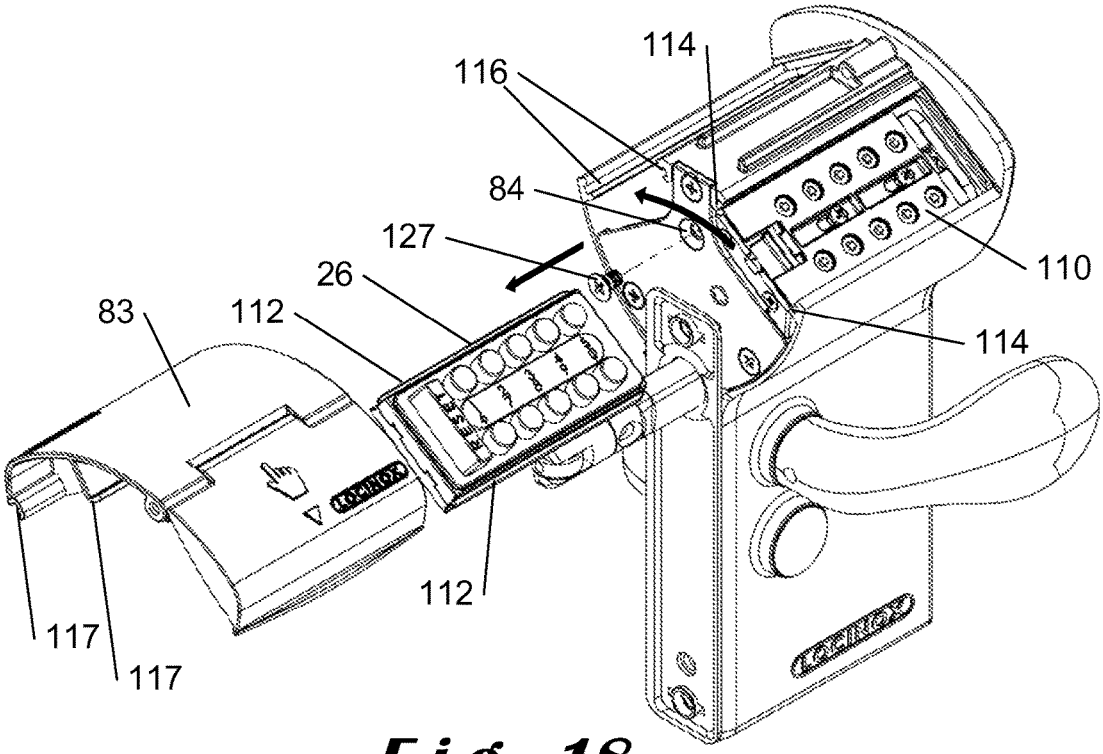
FIG. 18 illustrates next steps in the process started in FIG. 17.

Subsequently, as illustrated in FIG. 18, the top cover 83, which is mounted by sliding walls 117 in the grooves 116 of the cover box 2, can now be removed by sliding the walls 117 out of the grooves 116. Further, the keyboard 26, which is mounted by sliding outwards projecting grooves 112 in the other pair of grooves 114 of the cover box 2, can now be removed by sliding the outwards projecting grooves 112 out of the grooves 114. The lock mechanism 110 is now ready to be rotated around the shaft 62 but is still fixed with respect to the cover box 2 by screw 127. By removing screw 127, the locking mechanism 110 can rotate around the shaft 62 between his first and second end positions defined by walls on the inside of the support plate 81 as described above.

Figure 20:
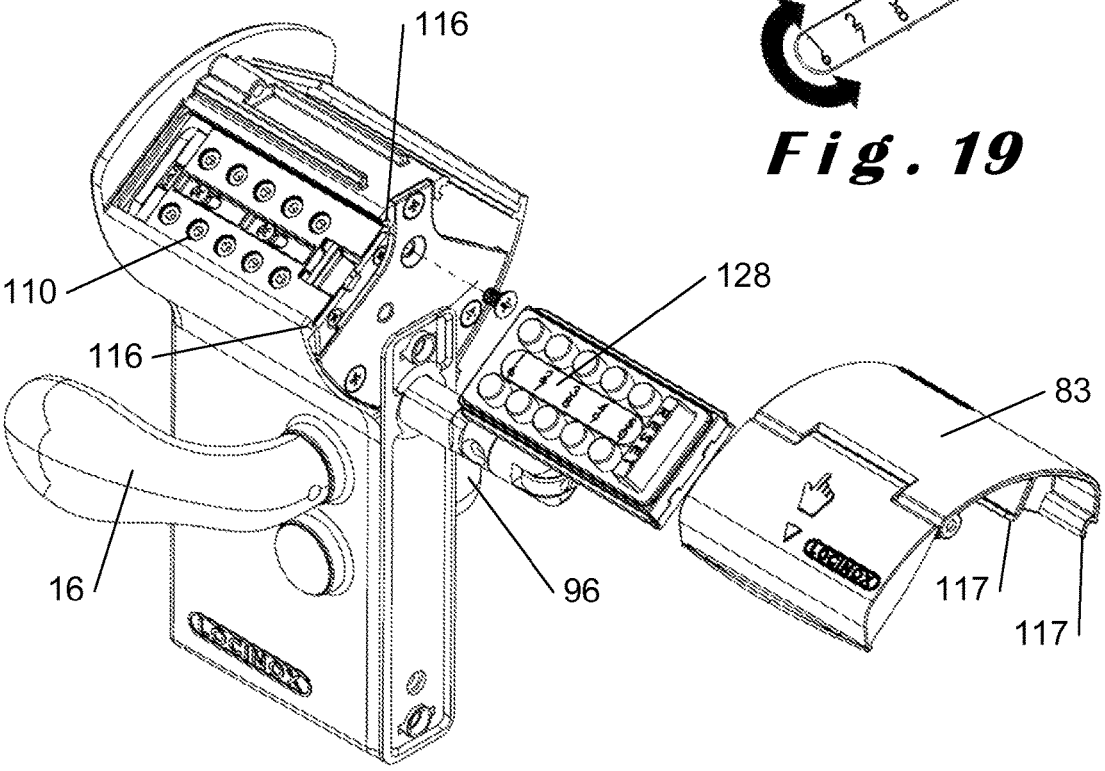
FIG. 20 illustrates still further steps in the process started in FIG. 17.
Figure 21:
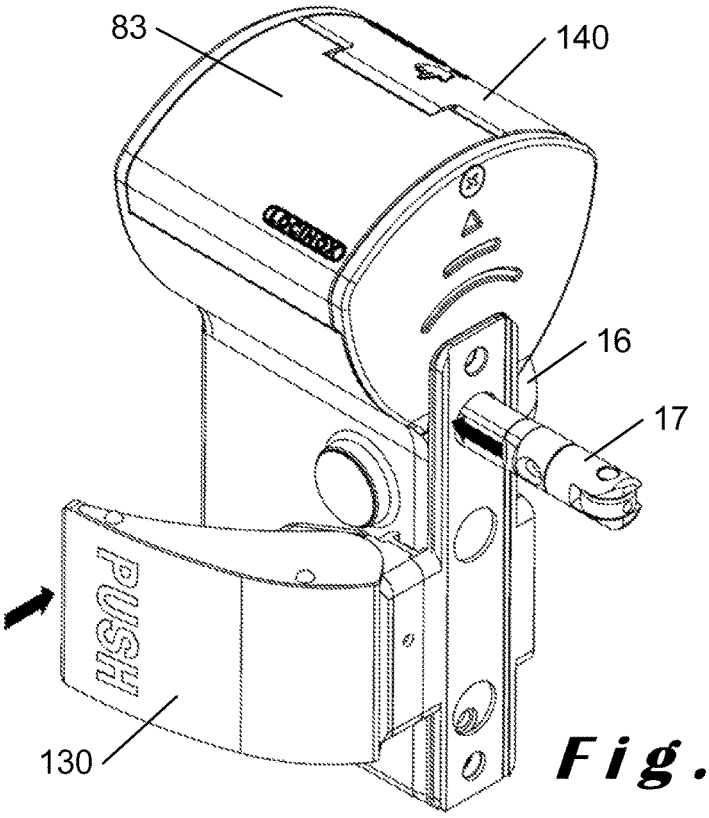
FIG. 21 shows a perspective view of A pushbutton combination lock according to an embodiment of the invention wherein the second actuating mechanism is operated by a push handle.

In a next step also illustrated on FIG. 18, the locking mechanism is rotated around the shaft 62 from his first position to his second position. In this second position the screw 127 is remounted to fix the locking mechanism on the other side of the lock 100 than it was at the start. The handles are now still at the wrong side. Therefore, the upper handle 16 and corresponding closure member 97 are disconnected from the frame, turned and remounted with the upper handle 16 now on the other side of the lock 100 as shown in FIG. 20. For the lower handle, the same step is done. The lower handle 96 and corresponding closure member 98 are disconnected from the frame 1, turned and remounted with the lower handle on the other side of the lock 100 than it was at the start. The result is illustrated in FIG. 20: lock mechanism 110, upper handle 16 and lower handle 96 are all on the opposite side compared to their position at the beginning of the reverse process shown in FIG. 18. In an alternative embodiment the locking mechanism is not rotatably mounted to frame but slidably mounted to the frame such that the locking mechanism is moved from the one side of the lock to the other side of the lock by a sliding movement. In one embodiment, the sliding movement is a support member mounted on the shaft 62 on which the locking mechanism can slide from the one side to the other. The check slide mover 59 has then a wall 131 with a side which is not concentric around the shaft 62 but substantially straight and perpendicular to the shaft 62 from the one side to the other.

Figure 19:
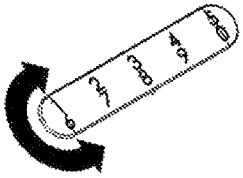
FIG. 19 illustrates the step in the process started in FIG. 17 to rotate the numeric display.

The keyboard 26 can now be mounted again by sliding the outwards projecting grooves 112 into the inwards grooves 116 of the cover box 2. As illustrated in FIG. 19, the numeric display 128 has to be rotated 180° to be able to read numbers. The top cover 83 is mounted to the cover box by sliding the pair of walls 117 of the top cover 83 into the pair of grooves 114 of the cover box 2. Finally, to close the housing completely and to keep the keyboard 26 and the top cover 83 in position, the side cover 3 is mounted and fixed with screw 31. The lock 100 which was first useful for use with locking functionality from a first side is now ready for use with locking functionality from the opposite side.

Referring to FIGS. 21 to 24, in an embodiment of the invention the lower handle is a push handle 130. The advantage of a push handle on the side of the lock where the gate may be always opened is the ease of opening. No turning is required, just push. This is for example very useful for an emergency gate. The emergency gate can not be opened from the side where the pushbutton combination lock is under a rotatable part 140 of the top cover 83, and can be very easily opened in case of emergency on the side where the push handle 130 is available. With the same structure inside the cover box 2 as discussed above, the push handle 130 is not locked by the pushbutton combination locking mechanism but the handle 16 on the other hand is.

Figure 22:
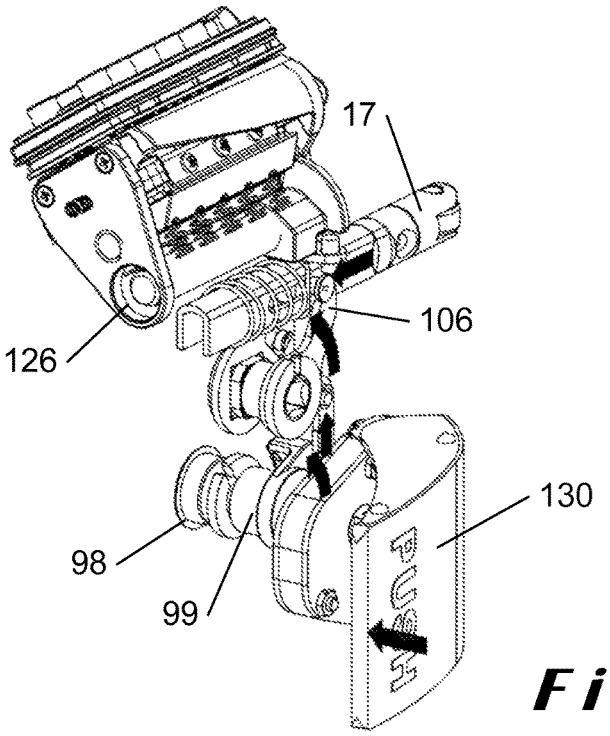
FIG. 22 shows a perspective view of the pushbutton combination lock of FIG. 21 with some components removed to illustrate movement of the internal structure when the push handle is operated.

With reference to FIG. 22, movement of the different parts is described starting at pushing the push handle 130. Pushing on the push handle 130 rotates the square axis of closure member 98. The square axis is provided through a square central hole of the follower 99 such that also the follower 99 is rotating. The follower 99 is linked to the second latch bolt lever 106 via the interconnection part 108 such that when the follower 99 is rotating in the direction illustrated in FIG. 22, the interconnection part 108 is moving upwardly and rotates the second latch bolt lever 106 in the same direction. The rotation of the second latch bolt lever 106 is in his turn moving the latch bolt 17 inwardly.

Figure 23:
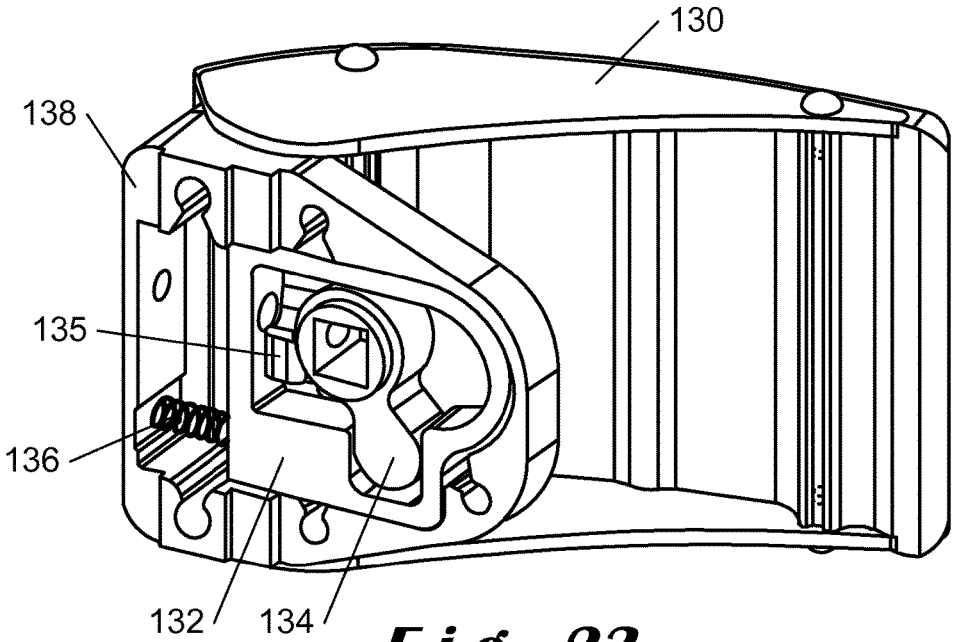
FIG. 23 shows a perspective view of the internal structure of the push handle used in the embodiment of FIG. 21.

FIG. 23 is illustrating the inside of the push handle 130. The push handle has a push handle lever 135, a first conversion member 132, a second conversion member 134, a spring 136, a push handle base 138.

Figure 24:
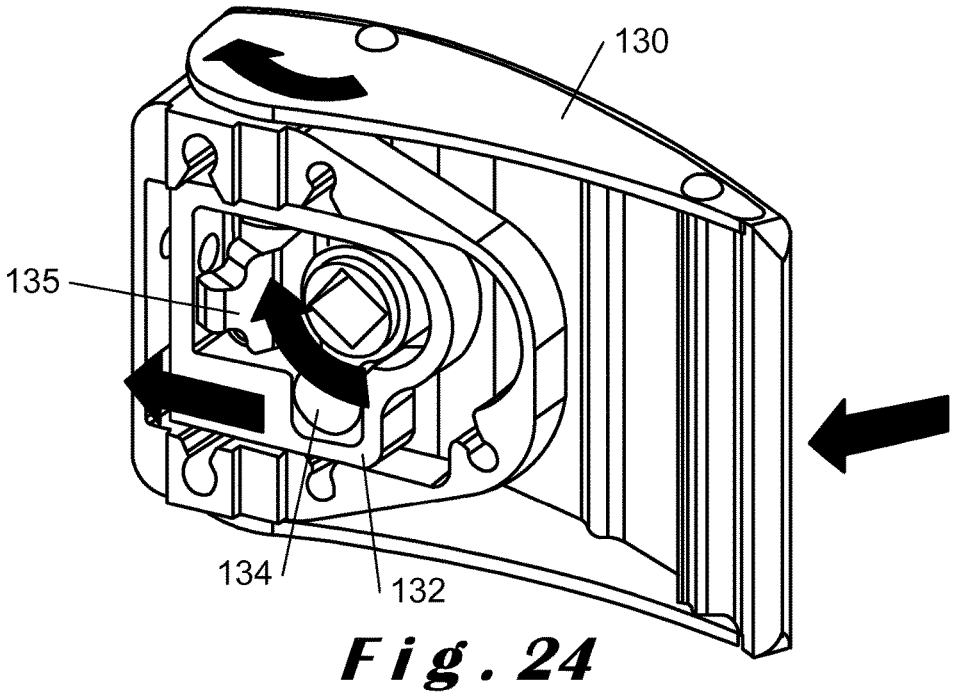
FIG. 24 shows how the movement of the push handle used in the embodiment of FIG. 21 is converted to a rotation movement of a handle axis.

Referring to FIG. 24, when pushing the push handle inwards, the handle part rotates around a vertical axis. This rotation rotates the push handle lever 135 which moves the first conversion member 132 in a translational movement against the action of spring 136. The translational movement of the first conversion member 132 rotates in his turn the second conversion member 134. The second conversion member 134 further comprises a square central hole to interact with a square handle axis. In this way, pushing the push handle 130 rotates the handle axis and thus the lock bolt activating mechanism.

The invention claimed is:

1. A pushbutton combination lock comprising:

a frame, a lock bolt mechanism comprising a lock bolt movably mounted on the frame between a locking position and an unlocking position, a first lock bolt actuating mechanism arranged to move the lock bolt between the locking position and the unlocking position and a second lock bolt actuating mechanism arranged to move the lock bolt between the locking position and the unlocking position, and a pushbutton combination locking mechanism, said pushbutton combination locking mechanism being arranged for locking said first lock bolt actuating mechanism to prevent the lock bolt from being moved by the first lock bolt actuating mechanism to the unlocking position, said pushbutton combination locking mechanism being arranged to be selectively mounted on the frame in a first pushbutton position or a second pushbutton position, wherein in said first pushbutton position said pushbutton combination locking mechanism is operable from a first side of the lock and in said second pushbutton position said pushbutton combination locking mechanism is operable from a second side of the lock opposite to the first side of the lock, the pushbutton combination locking mechanism being rotatably mounted on the frame from the first pushbutton position to the second pushbutton position, and said second lock bolt actuating mechanism being operable independently from said pushbutton combination locking mechanism.

2. A pushbutton combination lock according to claim 1, further comprising a first operating means reversibly mounted to said first lock bolt actuating mechanism for operating said first lock bolt actuating mechanism and a second operating means reversibly mounted to said second lock bolt actuating mechanism for operating said second lock bolt actuating mechanism.

3. A pushbutton combination lock according to claim 1, wherein said pushbutton combination locking mechanism is rotatably mounted on the frame from the first pushbutton position to the second pushbutton position by rotation around an axis located parallel to the lock bolt and in a plane substantially in the middle between said first and second sides of the lock.

4. A pushbutton combination lock according to claim 1, wherein said first lock bolt actuating mechanism comprises a first lever arranged to act on the lock bolt, and said second lock bolt actuating mechanism comprises a second lever arranged to act on the lock bolt, and wherein said first lever and second lever are arranged to act on the lock bolt independently.

5. A pushbutton combination lock according to claim 4, wherein said first lock bolt actuating mechanism is arranged to rotate about a first axis of rotation, and said second lock bolt actuation mechanism is arranged such that operation by a second operating means rotates a first part of said second lock bolt actuating mechanism about a second axis of rotation and said second lever about said first axis of rotation.

6. A pushbutton combination lock according to claim 1, wherein said frame comprises a cover box with a first and a second pair of grooves and a top cover with a fixed top cover part and a lid, the fixed top cover part comprising a pair of walls selectively mountable in the first pair of grooves or in the second pair of grooves such that the lid is selectively at the first or second side of the lock.

7. A pushbutton combination lock according to claim 6, said lock further comprising a keyboard for operating said pushbutton combination locking mechanism, wherein said keyboard is selectively mountable in the first pair of grooves or in the second pair of grooves corresponding to the side where the pushbutton combination locking mechanism is mounted.

8. A pushbutton combination lock according to claim 6, wherein said frame further comprises a basic frame to which the pushbutton combination locking mechanism is rotatably mounted and a side top cover, such that when the top cover, the basic frame and the side top cover are mounted on the cover box, a closed housing is formed in which the pushbutton combination locking mechanism is mountable in the two pushbutton positions.

9. A pushbutton combination lock according to claim 1, wherein said pushbutton combination locking mechanism comprises a check slide mover movably mounted to the frame, wherein said check slide mover is arranged to block or release said first lock bolt actuating mechanism depending on the pushbutton combination pressed on the pushbutton combination locking mechanism.

10. A pushbutton combination lock according to claim 1, wherein said pushbutton combination locking mechanism comprises at least one mounting member for rotatably mounting said pushbutton combination locking mechanism on said frame.

11. A pushbutton combination lock according to claim 10, wherein said frame comprises a fixed shaft and said at least one mounting member is rotatably mounted on the shaft.

12. A pushbutton combination lock according to claim 9, wherein said check slide mover is slidably mounted on a shaft.

13. A pushbutton combination lock according to claim 1, wherein said frame has a first opening defining the first pushbutton position of said pushbutton combination locking mechanism and a second opening defining the second pushbutton position of said pushbutton combination locking mechanism.

14. A pushbutton combination lock according to claim 1, wherein said pushbutton combination locking mechanism is fixed to said frame when mounted in said first pushbutton position or in said second pushbutton position.

15. A pushbutton combination lock according to claim 2, wherein said second operating means comprises a push handle with an axis of rotation perpendicular to an axis of rotation of the second lock bolt actuating mechanism when operated by said second operating means.

* * * * *